US005853265A

United States Patent [19]

Gunter

[11] Patent Number: 5,853,265

[45] Date of Patent: Dec. 29, 1998

[54] EDGE ADAPTER FOR ATHLETIC PLAYING SURFACE AND ASSOCIATED METHOD

[75] Inventor: Charles E. Gunter, Statesville, N.C.

[73] Assignee: ABT, Inc., Troutman, N.C.

[21] Appl. No.: 857,357

[22] Filed: May 16, 1997

Related U.S. Application Data

[62] Division of Ser. No. 568,254, Dec. 6, 1995, Pat. No. 5,647,692.

[51] Int. Cl.[6] ..... E02B 5/00

[52] U.S. Cl. ..... 405/118; 404/4; 405/36; 405/121; 472/92

[58] Field of Search ..... 405/118–121; 404/2, 4, 25, 26

[56] References Cited

U.S. PATENT DOCUMENTS

| | | | |
|---|---|---|---|
| Re. 26,366 | 4/1968 | Flegel . | |
| Re. 33,439 | 11/1990 | Thomann et al. . | |
| 3,418,897 | 12/1968 | Humalainen | 472/92 |
| 3,433,137 | 3/1969 | Henderson . | |
| 3,625,011 | 12/1971 | Stevenson . | |
| 3,682,476 | 8/1972 | Kempson, et al. . | |
| 4,312,504 | 1/1982 | Rutledge, et al. . | |
| 4,472,078 | 9/1984 | Karbstein . | |
| 4,505,814 | 3/1985 | Marshall | 404/26 X |
| 4,515,498 | 5/1985 | Thomann, et al. . | |
| 4,553,874 | 11/1985 | Thomann, et al. . | |
| 4,560,302 | 12/1985 | Karbstein . | |
| 4,621,939 | 11/1986 | Thomann, et al. . | |
| 4,630,962 | 12/1986 | Thomann et al. . | |
| 4,630,966 | 12/1986 | Karbstein . | |
| 4,640,643 | 2/1987 | Williams . | |
| 4,699,544 | 10/1987 | Karbstein . | |
| 4,751,945 | 6/1988 | Williams . | |
| 4,787,773 | 11/1988 | Kehler . | |
| 4,838,727 | 6/1989 | Capuano . | |
| 4,913,596 | 4/1990 | Lambert, III . | |
| 4,940,359 | 7/1990 | Van Duyn et al. . | |
| 5,106,231 | 4/1992 | Thomann . | |
| 5,110,235 | 5/1992 | Thomann et al. . | |
| 5,120,157 | 6/1992 | Todd, Sr. et al. . | |
| 5,135,331 | 8/1992 | Steiner . | |
| 5,213,438 | 5/1993 | Bärenwald . | |
| 5,226,748 | 7/1993 | Bärenwald et al. . | |
| 5,356,147 | 10/1994 | MacDonald . | |

FOREIGN PATENT DOCUMENTS

| | | |
|---|---|---|
| 0056238 | 7/1982 | European Pat. Off. . |
| 0109065 | 5/1984 | European Pat. Off. . |
| 5-132909 | 5/1993 | Japan . |

OTHER PUBLICATIONS

*Polydrain® Special Products*pamphet by ABT®, Inc.

*Aco Sport® Running Track Drainage & Bordering*pamphet by ACO polymer Products, Inc., Lit. No. 1–1–89 Copyright 1989.

*Polydrain® The Simple solution To Surface Drainage Sloped System Manual*by ABT®, Inc., Copyright 1992.

*Primary Examiner*—Dennis L. Taylor

*Attorney, Agent, or Firm*—Bell Seltzer Intellectual Property Law Group of Alston & Bird, LLP

[57] ABSTRACT

A resilient edge adapter is provided for defining an edge of a drainable athletic playing surface formed of a moldable material. The edge adapter includes a base portion for cooperably engaging an upper portion of a drainage channel and an upstanding portion extending upwardly from the base portion for restraining the moldable material when applied adjacent to the drainage channel, thereby defining an edge of the athletic playing surface. The upstanding portion may be formed of a resilient and elastically deformable material and the base portion may include an elongate continuous plug portion to cooperably engage a corresponding slot defined in the upper edge of the channel. An edge adapter is also provided which has a pair of upstanding portions extending upwardly from a base portion for forming a running track surface over both opposed edges of a grate. Associated methods for forming athletic playing surfaces are also provided.

11 Claims, 3 Drawing Sheets

EDGE ADAPTER FOR ATHLETIC PLAYING SURFACE AND ASSOCIATED METHOD

This application is a divisional of application Ser. No. 08/568,254, filed Dec. 6, 1995 now U.S. Pat. No. 5,647,692.

FIELD OF THE INVENTION

The present invention relates to athletic playing surfaces and more particularly relates to edge adapters for defining an edge of an athletic playing surface.

BACKGROUND OF THE INVENTION

Athletic playing fields such as football and soccer fields or running tracks are typically provided with an artificial surface formed of a resilient and wearable material. In particular, a running track surface may include a polymeric surface layer which is substantially impervious to liquids. Accordingly, a running track surface is often provided with a drainage channel along an edge of the track surface for receiving and collecting liquid runoff. Another running track surface or another type of athletic surface, such as an artificial turf surface or a natural grass surface, may be positioned adjacent to the opposite side of the drainage channel. These other athletic surfaces may also require drainage and, in some instances, may be slightly crowned or sloped from the center to the edges to ensure proper drainage into the adjacent channel.

In forming an athletic playing surface adjacent to a drainage channel, a variety of subsurface layers are built up against the channel to a predetermined level such that a surface layer, which typically has a predetermined thickness, will have an exposed upper surface which is at a desired level. For example, for running track surfaces, an asphalt layer, which may or may not be porous, is applied over an underlying gravel layer to a predetermined elevation. A relatively thin running track surface is then formed over the asphalt layer such that the uppermost surface of the running track surface is at the desired horizontal elevation.

Such a running track surface is typically formed by pouring a moldable material, such as a urethane polymer, adjacent to the drainage channel and allowing the material to cure, thereby forming a resilient surface layer. Because the moldable material is applied in a substantially liquid form, it is desirable that the moldable material be restrained during formation so that the resulting track surface has a well-defined edge after the material has cured.

With conventional running track surfaces, the desired level of the upper exposed surface of the surface layer is often at or below the upper surface of the channel sidewall. Accordingly, the sidewall of the channel acts as a dam to restrain the moldable material while it cures. However, in these instances, the relatively hard upper surface of the drainage channel will generally be exposed to the surface, thereby creating a potential safety hazard for athletes and others.

For some athletic playing surfaces, it is desirable to form the underlying asphalt layer to an elevation corresponding to an upper surface of the sidewall of the channel. Accordingly, the running track surface will typically be formed above the upper surface of the sidewall to the desired thickness. As will be apparent to those skilled in the art, the sidewalls of the drainage channel can no longer serve as a dam during the formation of a running track surface above the upper surface of the sidewall, thereby significantly complicating the running track formation process.

For other athletic surfaces, however, a thinner running track surface is desired in order to reduce the overall cost of the athletic playing field even though the upper surface of the running track is preferably maintained at the same elevation as before. In such situations, a thicker asphalt layer is generally applied over the underlying gravel layer to an elevation slightly higher than the upper surface of the sidewall. Moldable material may then be applied over the thicker asphalt layer to the same elevation as before, thereby resulting in a thinner and less costly surface layer. As described above, however, the process of forming both the asphalt layer and the surface layer is significantly complicated since the sidewalls of the drainage channel can no longer serve as a dam for surfaces formed above the upper surface of the sidewall.

For artificial turf surfaces, the asphalt layer is typically thinner than the asphalt layer described above so that a layer of cushioning foam and the artificial turf may be applied thereover to provide an uppermost surface at the desired level. However, the subsurface layers should still be applied to the proper elevation relative to the drainage channel so that the uppermost exposed surface of the playing surface is located at the proper elevation.

Regardless of the type of athletic surface bordering the drainage channel, an elongate grate is typically provided over the drainage channel so as to cover the open top of the channel in order to prevent people from unwittingly stepping into the open channel and/or to prevent relatively large objects from entering the channel and partially blocking the flow of liquid therethrough. While the grate effectively covers the open top of the drainage channel, the drainage system and, in particular, the portion of the grate which is exposed to the surface can decrease the aesthetic appeal of the athletic playing fields. Since the drainage channel commonly extends along or between athletic surfaces over which a number of people and vehicles will be passing, it is desirable for the drainage channel and, more particularly, the grate to be free of upstanding protrusions. In addition, because the grate is substantially rigid, it is desirable that the grate be cushioned relative to the channel in response to downward loading forces applied to the grate, such as a falling athlete.

A system of grate edging is commercially available under the trademark Aco Sport® from Aco Polymer Products, Inc. to border natural grass surfaces, artificial turf surfaces and/or running track surfaces. The Aco Sport® system includes a number of drainage channel configurations which, in some embodiments, are covered by a variety of grates and/or a polymer concrete hard cover. A number of the Aco Sport® drainage systems include a border or curb formed of ethylene-propylene diene monomer ("EPDM") which delineates the boundary between the adjacent athletic surfaces. Due to the upwardly extending EPDM border, athletes or others must step over the EPDM border to pass over the EPDM border and between the adjacent athletic surfaces. In addition, athletic surfaces which border the Aco Sport® drainage system are also typically at different elevations so as to create an additional barrier to passing between the athletic playing surfaces.

U.S. Pat. No. 4,553,874 to Thomann et al. describes another type of drainage system. In particular, Thomann et al. discloses a slotted grate intended to fit within a preformed cast drainage channel section. The channel section includes a drainage channel body and a cast frame supported thereon for supporting the channel grate. The channel body may be manufactured of polymer concrete and is provided with protrusions on each side to firmly anchor the drainage channel body within a concrete foundation, which encases most of the channel body. Guide tabs on the cast frame intermesh with a pavement layer which may be formed over the concrete.

As described above, several drainage systems, including the Aco Sport® drainage system, have been developed which border athletic playing surfaces in order to receive runoff therefrom. However, these drainage systems still do not fully address the needs of modern athletic playing surfaces. For example, the prior drainage systems do not define an edge of a polymer athletic surface, such as a running track, or a subsurface layer formed adjacent to the drainage channel and above the uppermost portion of the drainage channel sidewall. Further, at least some of these prior drainage systems do not maintain the athletic playing surfaces which are adjacent to the opposed sides of the drainage channel in a level orientation in order permit athletes and others to more readily pass thereover.

SUMMARY OF THE INVENTION

These and other needs of modern athletic playing surfaces are met, however, by the resilient edge adapter of one embodiment of the present invention which defines an edge of a drainable athletic playing surface. The edge adapter includes a base portion for cooperably engaging an upper portion of a drainage channel which is capable of receiving runoff from the athletic playing surface. The edge adapter also advantageously includes an upstanding portion extending upwardly from the base portion for restraining moldable material when applied adjacent to the drainage channel to thereby define an edge of the resilient athletic playing surface once the moldable material cures.

The upstanding portion is advantageously formed of a resilient and elastically deformable material such that both the upstanding portion and the athletic playing surface can at least partially elastically deform in response to loading forces applies hereto. Thus, the feel of the edge adapter underfoot is improved since it elastically deforms in a similar manner to the adjacent athletic playing surface. Such material advantageously has a hardness of less than about 95 durometer and, more preferably, less than 90 durometer and, in one embodiment, is formed of plasticized polyvinylchloride or vinyl rubber. In addition, the base portion of the adapter is also advantageously formed of a resilient and elastically deformable material so as to cushion the grate.

According to one embodiment, the upstanding portion includes a planar wall extending upwardly from an edge of the base portion. According to another embodiment, the upstanding portion includes a first vertical wall portion extending upwardly from an edge of the base portion, a horizontal wall portion extending horizontally from an upper edge of the first vertical wall to an inner edge and a second vertical wall portion extending upwardly from the inner edge of the horizontal wall portion. Accordingly, the upstanding portion advantageously extends over an exterior edge of a grate.

The edge adapter can cooperably engage an upper portion of a drainage channel which receives runoff from an athletic playing field according to one aspect of the present invention. In addition, the upstanding portion of the edge adapter can serve to restrain the moldable material which forms the athletic playing field to thereby define an edge of the athletic playing field once the moldable material cures. Moreover, the edge adapter advantageously has an upper edge which defines a level to which the moldable material is applied such that the edge adapter also serves as an installation guide during formation of the athletic playing field.

The edge adapter may also include, according to another embodiment of the invention, an elongate continuous plug portion for cooperably engaging a corresponding slot defined in the upper edge of a sidewall of the channel. The continuous plug portion extends downwardly from a lower surface of the base portion and includes means for creating friction within the corresponding slot, such as a plurality of laterally extending and compressible barbs.

According to another aspect of the present invention, the drainage channel, including an edge adapter, may have an athletic playing surface formed of a moldable material applied adjacent to one side of the channel and an artificial turf surface having a predetermined crush height applied adjacent to the opposite side of the drainage channel. The edge adapter advantageously has a base portion with a predetermined thickness substantially equal to the predetermined crush height of the athletic turf surface, which may be between about 3 mm to 7 mm. A grate may be supported on the base portion so as to extend over the open top of the drainage channel in a predetermined aligned relationship with the athletic playing surface formed of the moldable material on one side of the drainage channel and with the artificial turf surface on the other side of the drainage channel. Thus, the adjacent playing surfaces and the drainage channel, including the edge adapters and grate, will provide a level surface for the athletes and others According to another aspect of the present invention, a temporary edge adapter is provided for defining an edge of a subsurface layer formed above an upper edge of a drainage channel before the application of an overlying surface layer. The temporary edge adapter includes a base portion having a lower surface. The base portion advantageously includes an edge surface extending upwardly from the lower surface to an upper edge which defines a level to which the subsurface layer is applied such that the temporary adapter serves as an installation guide during formation of the subsurface layer.

According to yet another aspect of the present invention, an edge adapter can define an edge of an athletic surface formed from a moldable material applied at least partially over a grate of a drainage channel. A base portion of the edge adapter supports the adapter on the grate and defines a plurality of openings for allowing runoff from the athletic surface to flow through the edge adapter and the grate and into the drainage channel. An upstanding portion for restraining the moldable material when the athletic surface is formed on the grate may advantageously include a pair of upstanding portions extending upwardly from opposed sides of the base portion to thereby form a generally U-shaped edge adapter. A plurality of fastening members may extend through the openings in the base portion for fastening the edge adapter to the grate.

The present invention also includes associated methods for forming an athletic playing surface and, according to one embodiment, include the steps of forming a subsurface layer adjacent an upper edge of a drainage channel and mounting an edge adapter having at least one upstanding portion to the upper edge of the drainage channel. A moldable material is applied over the subsurface layer such that the upstanding portion of the edge adapter prevents the moldable material from flowing into the channel. The moldable material is then cured to form a resilient athletic surface having an edge defined by the upstanding portion of the adapter.

The subsurface layer formation step may include the step of mounting a temporary adapter to the upper edge of the drainage channel, wherein the temporary adapter has a smaller upstanding portion than the upstanding portion of the edge adapter. The subsurface layer may then be formed to a level corresponding to an upper edge of the upstanding portion of the temporary adapter. The temporary adapter is then removed from the upper edge of the drainage channel prior to mounting the edge adapter thereto.

Therefore, the edge adapters and associated drainage channels of the present invention effectively define an edge of an adjacent athletic surface. In particular, the edge adapters can serve as a dam during formation of the adjacent athletic surface from a moldable material to create a well-defined edge once the moldable material cures. Moreover, the edge adapters of the present invention are preferably resilient so as to elastically deform upon the application of loading forces, thereby improving the feel of the edge adapter underfoot. Further, the edge adapters of one embodiment of the present invention allow at least a portion of the grate to be covered by an athletic playing surface to further improve the aesthetic appearance of the drainage channel. In addition, the variety of edge adapters of the present invention can permit a single type or style of drainage channel to be installed adjacent a variety of athletic surfaces, thereby increasing the installation flexibility of this drainage system and limiting the fabrication costs associated with manufacturing the drainage channel sections.

BRIEF DESCRIPTION OF THE DRAWINGS

Some of the objects and advantages of the present invention having been stated, others will appear as the description proceeds, when taken in connection with the accompanying drawings, which are not necessarily drawn to scale.

DETAILED DESCRIPTION OF THE PREFERRED EMBODIMENTS

Figure 1:
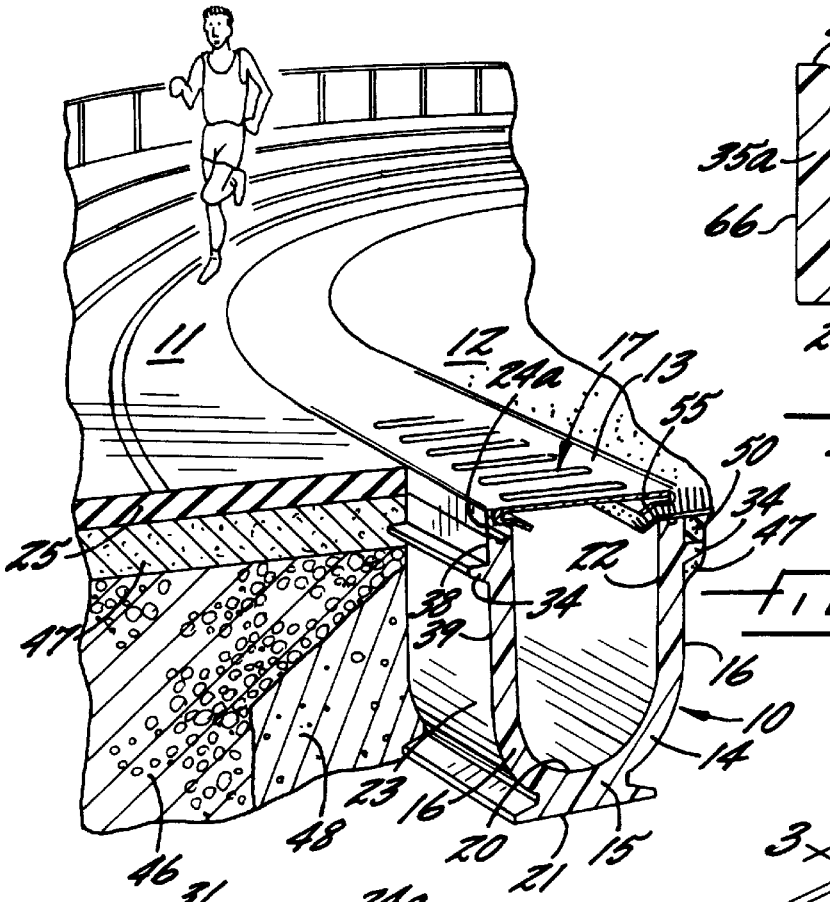
FIG. 1 is an environmental sectional view of a drainage channel and edge adapter according to the present invention illustrating a running track surface on one side of the channel and an artificial turf playing surface on the other side.

Various embodiments of the invention are set forth below. While the invention is described with reference to specific preferred devices and methods, including those illustrated in the drawings, it will be understood that the invention is not intended to be so limited. To the contrary, the invention includes numerous alternatives, modifications, and equivalents as will become apparent from consideration of the present specification including the drawings, the foregoing discussion, and the following detailed description.

FIG. 1 illustrates a drainage channel 10 positioned along the interior edge of a running track 11. The drainage channel 10 may also be installed at other locations relative to the athletic playing surface in question, such as outside a running track surface or along the edges of other athletic playing fields. For example, an artificial turf playing surface 12 is illustrated on the opposite side of the drainage channel 10 of FIG. 1 and may be used for playing football or other field sports. In addition, the drainage channel 10 could border a natural turf field or an asphalt or other paved surface.

A grate 13 is provided over the drainage channel 10 to prevent injury and to prevent relatively large objects, such as leaves and debris, from entering the channel and restricting the flow of liquid therethrough. As can be seen in FIG. 1, the grate 13 is arranged to provide a substantially planar and continuous transition surface between the running track 11 and the artificial turf 12 so that there are no protrusions which might trip athletes or interfere with the operation of various wheeled devices which may be used. Thus, the top of the drainage channel 10, running track 11, and artificial turf playing surface 12 are all at substantially the same level.

The drainage channel 10 may include a plurality of longitudinally extending preformed or precast drainage channel sections 14 arranged in an end-to-end relationship. The channel sections 14 can be precast from various cementitious materials depending upon the type of fluids which the channel 10 is to collect and the type of loads the channel is expected to support. For example, precast drainage channel sections 14 are typically formed of polyester concrete, a concrete aggregate material containing coarse and inert mineral fillers bonded with polyester resin. As will be apparent, according to certain embodiments of the invention, the channel sections 14 can be formed from other cementitious and/or thermoformable or thermosetting polymers or formed from cast or formed metals, such as stainless steel sheet. The channel sections 14 could also be formed of fiberglass.

The drainage channel section 14 may include a bottom wall 15 and a pair of sidewalls 16 extending upwardly from the opposed sides of the bottom wall so as to define an open top 17 for receiving the liquid runoff. The bottom wall 15 defines interior 20 and exterior 21 surfaces, and the sidewalls 16 each define interior 22 and exterior 23 surfaces. While the bottom wall 15 is shown to be thicker than the sidewalls 16, the bottom wall and sidewalls can have other relative dimensions without departing from the spirit and scope of the present invention. In addition, the interior surface 20 of the bottom wall 15 may be substantially U-shaped or V-shaped so as to blend into the interior surfaces 22 of the sidewalls 16. The bottom wall 15 may also have a uniform thickness along the length of the channel section 14, or, alternatively, the interior surface 20 of the bottom wall may be slightly sloped relative to the exterior surface 21 to enhance liquid flow along the channel 10.

The exterior surface 21 of the bottom wall 15 may be generally flat for stably supporting the drainage channel section 14, as discussed in more detail below. In addition, the exterior surface 21 of the bottom wall 15 may be extended outwardly when viewed in cross section so as to define a pedestal-type shape and to enhance the lateral stability of the drainage channel section 14

The grate 13 may be fastened to the channel 10 by way of a locking strap (not shown) secured in a recess in the sidewalls 16. A preferred locking strap is disclosed in U.S. Pat. No. Re. 33,439 to Thomann et al. and assigned to the assignee of the present invention, which is incorporated herein by reference.

A pair of longitudinally elongate projections 34 may extend transversely outwardly from the exterior surfaces 23 of the sidewalls 16. The projections 34 are spaced at a predetermined distance below the open top 17, such as between ¼ of an inch and one inch and, more preferably, about ⅝ths of an inch, and extend outwardly beyond at least a section 38 of the sidewall 16 above the projection and a section 39 of the sidewall below the projection. At least portions of the sections of the sidewall above 38 and below 39 the projection 34 may be generally coplanar with each other. These projections 34 are particularly advantageous for defining the horizontal level to which one or more of the subsurface layers should be formed.

A drainage channel which includes one or more projections and its associated fabrication and installation methods are described in detail in U.S. Pat. No. 5,653,553, issued Aug. 5, 1997, to Charles E. Gunter entitled "Drainage Channel and Associated Methods" filed concurrently herewith which is assigned to the assignee of the present invention and is incorporated by reference herein.

Figure 10:
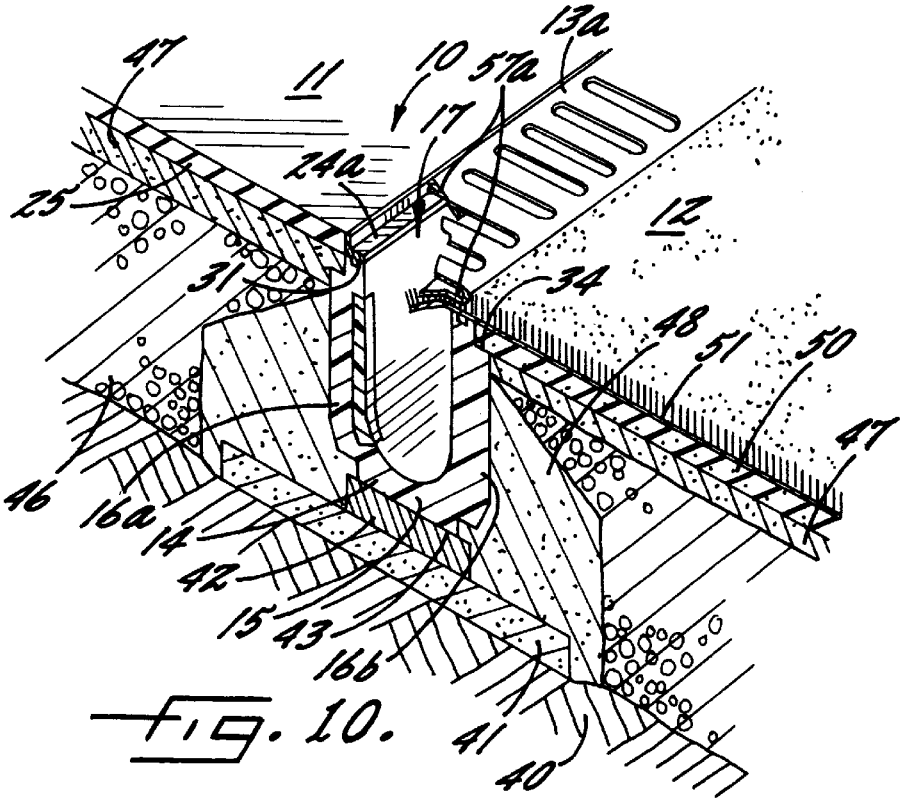
FIG. 10 is a perspective sectional view of a buried drainage channel illustrating the first embodiment of the edge adapter.
Figure 11:
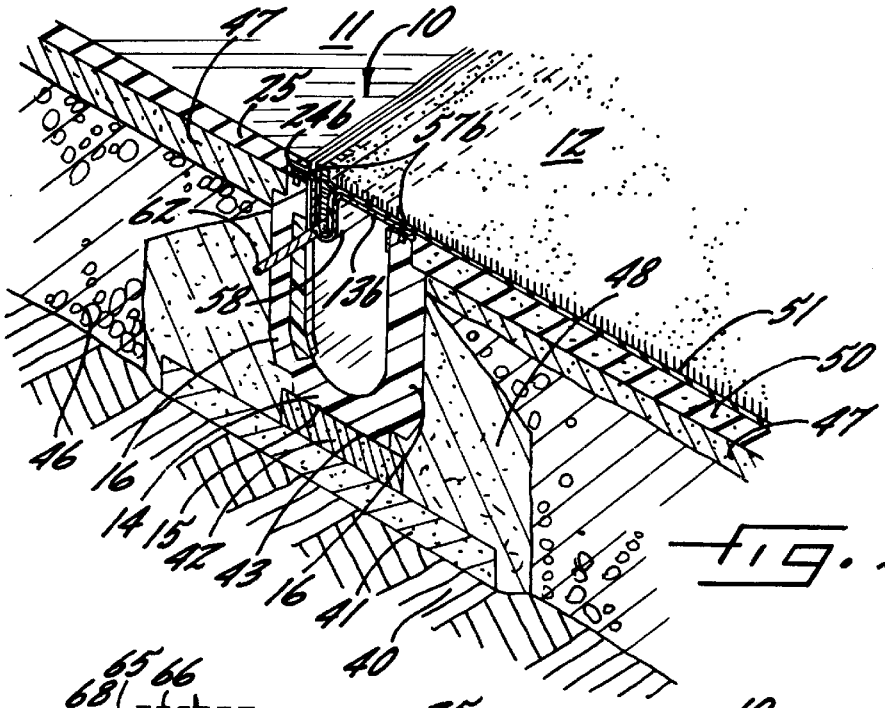
FIG. 11 is a perspective sectional view of a buried drainage channel illustrating the second embodiment of the edge adapter.
Figure 13:
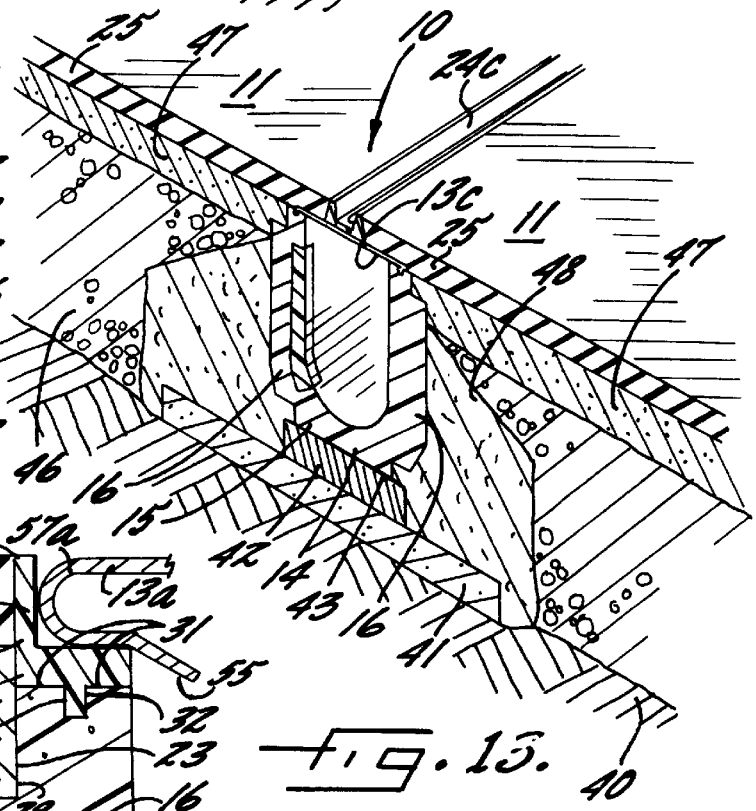
FIG. 13 is a perspective sectional view of a buried drainage channel illustrating the third embodiment of the edge adapter.

The subsurface and surface layers formed adjacent to the channel are illustrated in more detail in FIGS. 10, 11, and 13 and include a base surface 40 which is formed by appropriate grading with earth-moving equipment. A plurality of pads 41 of concrete or other supportive material are then formed on the graded base surface 40. While the concrete pads 41 are still wet, a support 42 for the drainage channel sections 14, such as a cement brick, is placed on each pad. Each of the support bricks 42 is then aligned with the other bricks by making minor adjustments to the bricks in the wet concrete.

A drainage channel section 14 may then be placed on two adjacent support bricks 42. The exterior surface 21 of the bottom wall 15 of the drainage channel sections 14 may be provided with cast generally planar reference surfaces 43 to ensure that adjoining channel sections 14 supported on a common support brick 42 will be vertically aligned at the open tops 17 and at the horizontal projections 34 of both of the adjoining sections. In addition, the end surfaces of each drainage channel section 14 may be provided with a male/female structure such that adjoining channel sections may be interlocked. A sealant or adhesive may be applied to the adjacent ends of the adjoining drainage channel sections to prevent leakage of the channel 10.

Encasement concrete 48 is then typically poured against the sidewalls 16 of the drainage channel 10 to secure the channel. A layer of gravel, rock, or sand 46 may then be applied over the encasement concrete 48 as illustrated in FIG. 11. An asphalt layer 47 is then generally formed over the gravel layer 46. The asphalt may be substantially porous or, in some embodiments, non-porous. The height to which the asphalt layer 47 is formed depends in part on the type of playing surface that is desired. For example, the left-hand side of the drainage channel 10 illustrated in FIG. 10 is provided with a running track surface 11, and, accordingly, the asphalt layer 47 may be formed to a height even with a horizontal upper surface 31 of the adjacent sidewall 16*a*.

An artificial turf surface is shown on the right-hand side of the drainage channel illustrated in FIG. 10, however, and the asphalt layer 47 is formed to a height corresponding to that of the outwardly extending projection 34 on the corresponding sidewall 16*b*. This projection 34 is spaced at a predetermined distance below the open top 17 that corresponds to the thickness of a foam layer 50 for supporting the artificial turf 51 which will be placed thereabove. This feature of the drainage channel of the present invention is thus advantageous as an installation guide for installers when forming the asphalt layer 47 in assuring that the uppermost surface of the athletic playing surface will be at the desired elevation.

Before application of the final surface layers, it may be necessary to mechanically compress or compact the subsurface layers adjacent to the drainage channel 10 to ensure proper packing. Vibratory tamping or rolling machinery may be used which, if improperly applied, could damage the structure of the channel 10 and require expensive replacement. In particular, the machinery could break the bottom wall 15 and/or sidewalls 16 of the drainage channel 10 causing it to leak or even collapse. According to the present invention, if the compressive force applied is too large and/or too close to the sidewall 16, however, the projection 34 will act as a mechanical fuse and will shear away from the sidewall. This shearing will relieve the applied compressive load without fracturing the sidewalls 16 and will signal to the machinery operator to move away from the channel 10 before the channel is structurally destroyed.

After formation of the asphalt layer 47 on the left-hand side of the drainage channel shown in FIG. 10, the running track surface 11 is then formed thereover. The running track surface 11 is formed by pouring a moldable material 25 over the porous asphalt layer 47 and allowing the material to cure leaving a resilient surface. In a preferred embodiment, the moldable material 25 comprises a urethane polymer. Before pouring the running track surface 11, however, an edge adapter 24 according to one of the embodiments of the present invention is mounted on the channel.

Figure 3:
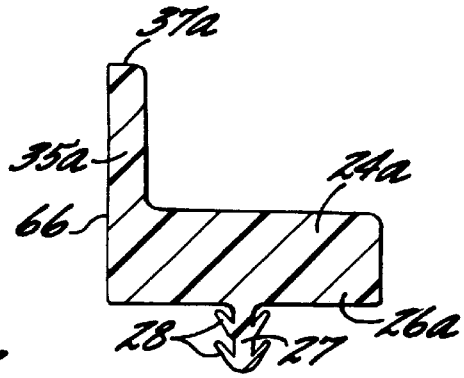
FIG. 3 is a sectional view of the edge adapter of FIG. 2 taken along lines 3—3.
Figure 2:
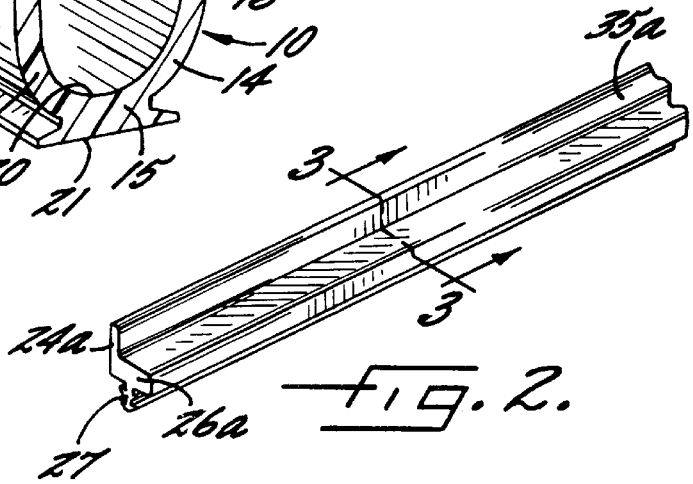
FIG. 2 is a perspective view of a first embodiment of an edge adapter according to the present invention.
Figure 3A:
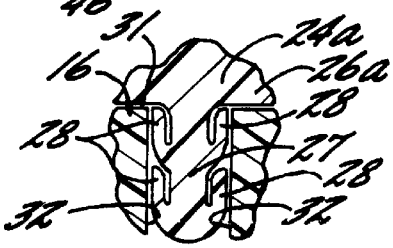
FIG. 3A is an enlarged sectional view of a plug portion of the edge adapter when installed in the sidewall of the drainage channel.

In particular, in a first embodiment illustrated in FIGS. 2 and 3, the edge adapter 24*a* includes a generally horizontal base portion 26*a* having a predetermined thickness as discussed below. A continuous plug portion 27 extends downwardly from the base portion 26*a* and is dimensioned to fit within a corresponding longitudinal slot 32 formed in the upper surface 31 of the sidewall 16. In a preferred embodiment, the slot 32 has a width of about 3 mm and a depth of about 4 mm. However, the dimensions of the slot and the plug portion can be readily varied without departing from the spirit and scope of the present invention. The downwardly extending plug portion 27 may be fitted with a plurality of laterally extending, compressible barbs 28, as shown in detail in FIG. 3A, to increase the frictional engagement between the plug portion and slot 32. In addition, the edge adapter 24*a* may be formed in lengths longer than a typical drainage channel section 14, which is about 1 m, so that the adapter can extend continuously along more than one section of the drainage channel 10, thereby creating a seemingly continuous edge to the drainage channel.

An upstanding portion 35*a* in the form of a planar wall extends upwardly from the base portion 26*a* and, in one embodiment, defines a vertical surface having an upper edge 37*a*. Thus, when the edge adapter 24*a* is secured in the slot 32, the planar wall acts as a dam to restrain the moldable material 25 of a running track surface 11 while it cures, as shown in FIG. 10. More specifically, the upstanding portion of the edge adapter prevents the moldable material 25 from flowing into the drainage channel 10 while it is still substantially liquid and provides a well-defined edge for the running track surface 11 once the material 25 has cured.

In addition, the upper edge 37*a* may define the maximum level to which the moldable material 25 is applied. Thus, according to a preferred embodiment, the planar wall of the upstanding portion 35*a* may have a height, such as about 13 mm, corresponding to the desired thickness of the polymeric running track surface 11. Accordingly, the upper edge 37*a* of the edge adapter can serve as an installation guide during pouring of the moldable material which forms the running track surface.

The edge adapter 24*a* is preferably formed of a resilient and elastically deformable material. This feature is advantageous because it provides a relatively soft edge for the running track surface 11 which can prevent injury. In particular, the upstanding portion 35*a* of the edge adapter 24*a* is preferably elastically deformable by an amount corresponding to that of the running track surface 11 so as to have a "foot-feel" which is similar to that of the running track surface.

In addition, the base portion 26*a* of the edge adapter 24*a* is also preferably elastically deformable so as to cushion the grate 13 relative to the channel 10. Because the channel 10 is preferably formed of cementitious material and the grate 13 is preferably formed of steel, heavy and/or repetitive loading of the grate could cause the upper edge 31 of the channel to become chipped or cracked if the grate were rigidly attached to the channel. However, the resilient and elastically deformable base portion 26*a* of the edge adapter 24*a*, upon which the grate 13 is supported, cushions the grate relative to the channel 10. In addition, the cushioning feature of the edge adapter 24*a* helps to further minimize the chance of injury to athletes who may fall on the grate.

Accordingly, the edge adapter 24*a* may have a Shore hardness of about 95 durometer or less and preferably about 90 durometer or less. In addition, the edge adapter 24*a* is pliable in a horizontal plane so that it may be bent around curved portions of the drainage channel 10 to create a seemingly continuous edge of the drainage channel. The edge adapter is also preferably chemically and UV stable. Thus, preferred materials for the edge adapter 24*a* include highly plasticized polyvinylchloride and vinyl rubber.

An artificial turf surface 11 may also be formed adjacent to the drainage channel of the present invention, such as on the opposite side of the drainage channel 10 from the running track surface, as shown in FIG. 10. In such situations, a foam layer 50 is applied over the asphalt layer 47 which has a thickness which places its upper surface at a level generally corresponding to the horizontal upper surface 31 of the right-hand sidewall 16*b*. The artificial turf layer 51 is then laid over the foam layer 50.

As can be best seen in FIGS. 1 and 10, the artificial turf layer 51 includes a backing layer and a plurality of stiff but pliable artificial fibers secured to the backing layer. The artificial turf layer thus has a predetermined thickness which may be reduced to a predetermined crush height by the bending and folding over of the artificial fibers when subjected to a compressive load.

The edge of the artificial turf layer 51 may extend over the sidewall 16 and into the interior of the channel 10 so that it is held between an exterior edge 57*a* of the grate 13*a* and channel when the grate is fastened to the drainage channel. The grate 13*a* may include an inwardly and downwardly extending surface 55, which may also include cleats or serrations (not shown), to firmly grip the edge of the artificial turf 51 and pull it tighter as the grate 13 is tightened down. In addition to drainage, the channel 10 and grate 13 thus also serve as a fixed anchor for the edge of the artificial turf 51. Accordingly, in some athletic facilities, the drainage channel 10 may serve solely as an edging and/or anchoring system and need not even to provide drainage.

This and other embodiments of the grate and associated installation methods are described in detail in U.S. Pat. No. 5,647,689, issued Jul. 15, 1997 to Charles E. Gunter entitled "Drainage Channel Grates for Athletic Playing Surfaces and Associated Methods" filed concurrently herewith which is assigned to the assignee of the present invention and is incorporated by reference herein.

In an alternative construction (not illustrated), the asphalt 47 and foam layers 50 may be replaced with one elastic or "E-layer" of the same thickness as the combined thicknesses of the asphalt 47 and foam 50 layers. The "E-layer" is resilient and serves a cushioning function to help prevent injury to athletes. The "E-layer" is typically formed of a plurality of discrete individual rubber particles held together in a binder.

In either instance, however, the base portion 26*a* of the edge adapter 24*a* of this embodiment preferably has a predetermined thickness generally equal to the crush height of the artificial turf layer 51, which is preferably about 5 mm. Accordingly, the grate 13*a* shown in FIG. 10 is advantageously supported above the upper surface 31 of both sidewalls 16*a*,16*b* of the drainage channel 10 on one side by the base portion of an edge adapter and on the other side by a crushed artificial turf surface so that the grate 13*a* is substantially horizontal and is aligned with both the artificial turf surface and the running track surface.

An alternative grate 13*b* for use between a running track surface 11 and an artificial turf playing surface 12 is illustrated in FIG. 11. As shown, the grate 13*b* has exterior edges 57*b* and includes a tuck slot 58 for securing an edge portion of the artificial turf layer 51 over the grate 13*b*. The artificial turf layer 51 is substantially porous which allows runoff to pass through the artificial turf and a plurality of holes (not shown) formed in the grate 13*b*. Accordingly, for safety and aesthetic reasons, it is advantageous to form the running track surface 11 as close as possible to the tuck slot 58 and the edge of the artificial turf 51, thereby substantially covering the grate 13*b*.

Figure 4:
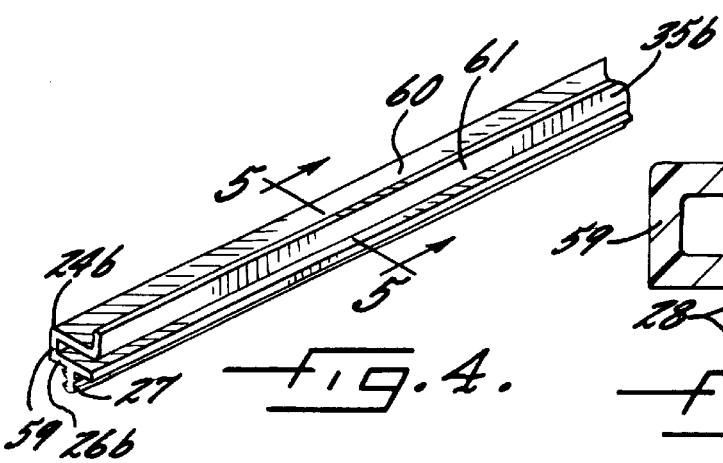
FIG. 4 is a perspective view of a second embodiment of an edge adapter according to the present invention.
Figure 5:
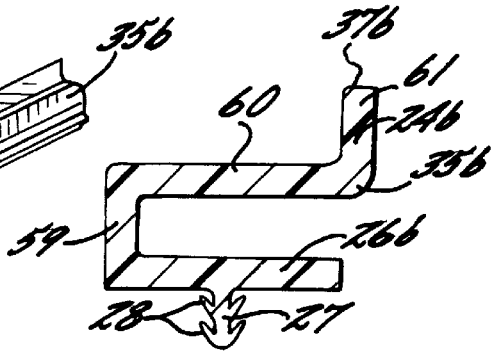
FIG. 5 is a perspective sectional view of the edge adapter of FIG. 4 taken along lines 5—5.

A second embodiment of the edge adapter 24*b* is adapted for use with the grate 13*b* of FIG. 11 and is illustrated in FIGS. 4 and 5. The second embodiment 24*b* includes a base portion 26*b* and a downwardly extending plug portion 27 with barbs 28 as discussed above in connection with the first embodiment 24*a*. In addition, the second embodiment 24*b* may be formed of the same resilient and elastically deformable material as the first embodiment 24*a*.

The second embodiment of the edge adapter 24*b* also includes an upstanding portion 35*b* for restraining the moldable material 25 during the formation of the running track surface 11. The upstanding portion 35*b* of the second embodiment includes a first vertical wall portion 59 extending upwardly from an edge of the base portion 26*b*, a horizontal wall portion 60 extending horizontally from the first vertical wall portion 59 to an inner edge, and a second vertical wall portion 61 extending upwardly from the inner edge of the horizontal wall portion 60 to an upper edge 37*b*. The base portion 26*b* and horizontal wall portion 60 are thus separated by a distance corresponding to the height of the first vertical wall portion 59. This distance is large enough to snugly accommodate the exterior edge 57*b* of the grate 13*b* shown in FIG. 11 and is preferably about 4 mm.

When forming the running track surface 11 as shown in FIG. 11, the second embodiment of the edge adapter 24*b* is first mounted on the sidewall 16 with the continuous plug portion 27 fitted within the longitudinal slot 32, as discussed above. The grate 13*b* is then placed on the drainage channel 10 with an exterior edge 57*b* positioned on the base portion 26*b* of the edge adapter 24*b* and below the horizontal wall portion 60.

The moldable material 25 for the running track 11 can then be poured against the upstanding portion 35*b* such that some of the material will flow over the horizontal wall portion 60 and against the second vertical wall portion 61. The artificial turf surface 51 may then be laid over the grate 13*b* and secured in the tuck slot 58. A cord 62 may be fitted into the tuck slot 58 to securely grip the edge of the artificial turf surface 51 in a folded position. Accordingly, the edge of the running track surface 11 will extend to a position immediately adjacent to the edge of the artificial turf 12 such that substantially the entire grate 13*b* is covered even though the drainage channel continues to receive runoff from the athletic playing surfaces.

In athletic facilities where a running track surface 11 is desired on both sides of the drainage channel 10, a grate 13*c* of the type illustrated in FIG. 13 may be provided. As described above, it is also advantageous to minimize the exposed surface of this grate 13*c*. The grate 13*c* of FIG. 13 advantageously includes two edge portions which have uninterrupted and substantially planar surfaces for supporting the running track surface 11. A medial portion of the grate 13*c* between the edge portions includes a plurality of openings 54 formed therein, as can be seen in FIG. 9 discussed below, for allowing runoff to pass through the openings and into the drainage channel 10.

Figure 8:
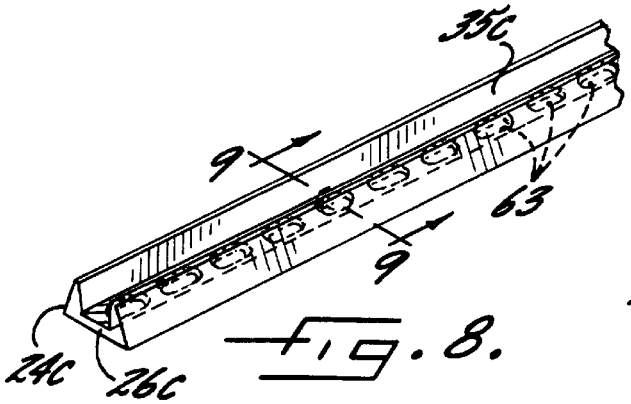
FIG. 8 is a perspective view of a third embodiment of an edge adapter according to the present invention.
Figure 9:
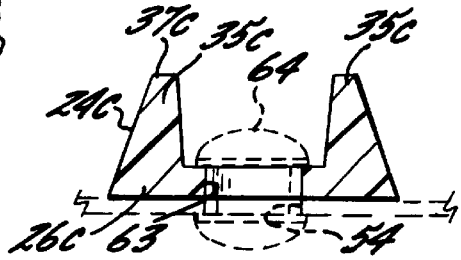
FIG. 9 is a sectional view of the edge adapter of FIG. 8 taken along line 9—9.

A third embodiment of an edge adapter 24*c* which is adapted for use with a grate 13*c* of the type shown in FIG. 13 is illustrated in FIGS. 8 and 9. The edge adapter 24*c* includes a horizontally extending base portion 26*c* and a pair of upstanding portions 35*c* extending upwardly from the base portion to an upper edge 37*c* to create a generally U-shaped edge adapter. The upstanding portions 35*c* may be vertical or inclined, as most clearly seen in FIG. 9. The upstanding portions 35*c* thus act as a dam in the manner discussed above to restrain the moldable material 25 of the running track surface 11 while being formed over both edge portions of the grate 13*c*. After the running track surfaces 11 have cured, the edge adapter 24*c* may be removed leaving adjoining running track surfaces 11 having adjacent well-defined edges. Alternatively, the edge adapter 24*c* could be formed of a degradable material such that the adapter disappears over time.

The edge adapter 24*c* according to the third embodiment may also be permanent, however, and formed of the same resilient and elastically deformable material of the first and second embodiments. The base portion 26*c* may be advantageously provided with a plurality of openings 63 which may be sized and spaced so as to be alignable with the openings 54 in the grate 13*c*. A plurality of fasteners 64, such as rivet-like fasteners, may be provided in selected aligned openings of the edge adapter 24*c* and grate 13*c* to secure the adapter to the grate. Accordingly, runoff will flow over the generally impervious running track surfaces 11, over the upstanding portions 35*c* of the edge adapter 24*c*, through the aligned openings 63,54 in the base portion 26*c* and the grate 13*c*, and into the drainage channel 10.

While the third embodiment of the edge adapter 24*c* as illustrated and described herein is disposed upon a central portion of the grate 13*c* in order to be properly aligned with the openings 68 defined therein, the grate 13*c* could, instead, define a number of openings in other locations offset from the center, such as a row of linearly disposed openings formed along an edge of the grate. In addition, the grate 13*c* could define several rows of openings formed linearly along the length of the grate. Thus, one or more edge adapters 24*c* of this embodiment can be disposed in other positions upon the grate 13*c* so as to be in alignment with the openings defined by the grate without departing from the spirit and scope of the present invention.

Figure 7:
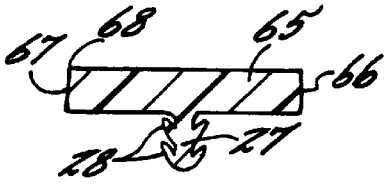
FIG. 7 is a sectional view of the temporary edge adapter of FIG. 6 taken along lines 7—7.
Figure 6:
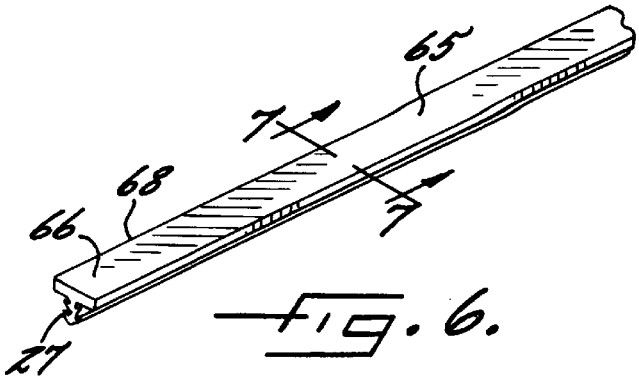
FIG. 6 is a perspective view of a temporary edge adapter according to the present invention.
Figure 12A:
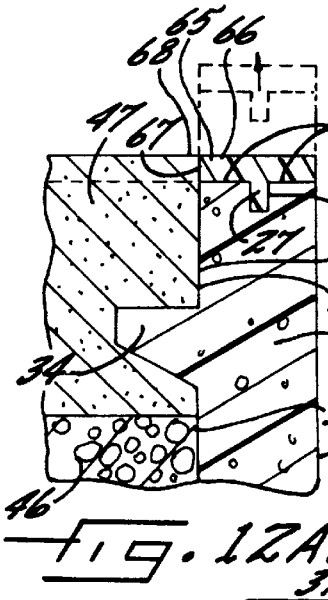
FIGS. 12A is a fragmentary sectional view illustrating a temporary edge adapter and an adjacent subsurface layer.

For some athletic facilities, a thinner and, therefore, less costly running track surface 11 adjacent to the grate 13 may be desired. Accordingly, the asphalt subsurface layer 47 is preferably formed to a level higher that the upper surface 31 of the drainage channel sidewall 16. In order to define this higher level, a temporary edge adapter 65 according to another embodiment of the present invention is provided as illustrated in FIGS. 6, 7, and 12A The temporary edge adapter 65 includes a base portion 66 of a predetermined thickness for defining an upwardly extending surface 67 for restraining the asphalt layer 47. The upwardly extending surface 67 includes an upper edge 68 which defines the maximum level to which the asphalt layer 47 is applied. For example, in one preferred embodiment, the base portion 66 defines an upwardly extending surface 67 having a height of approximately 3 mm.

Figure 12B:
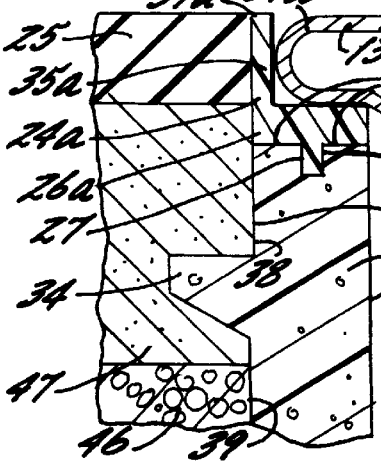
FIG. 12B is a fragmentary sectional view illustrating the first embodiment of the edge adapter adjacent a running track surface which has been formed over the subsurface layer after the temporary edge adapter has been replaced by the first embodiment of the edge adapter.

After the asphalt layer 47 has been formed, the temporary edge adapter 65 is removed as shown in dotted lines in FIG. 12*a* and replaced with a permanent edge adapter 24*a* . FIG. 12B illustrates the first embodiment of the edge adapter 24*a* and the thinner layer of moldable material 25 which is formed adjacent thereto. It will be understood, however, that the temporary edge adapter 65 could also be replaced by the second embodiment 24*b* of the edge adapter, if so desired.

The temporary edge adapter 65 may also be used in the construction of the channel configuration illustrated in FIG. 11. In particular, a temporary edge adapter 65 having a thickness corresponding to the thickness of the exterior edge 57*b* of the grate 13*b* under the artificial turf layer 51 may be used to define the edge of a subsurface layer 47 formed adjacent thereto. Accordingly, the upper surface of the grate 13*b* and the subsurface layer 47 will be at the same level so that the artificial turf layer 51 may be applied over a substantially planar and uninterrupted surface.

As described above, each of the edge adapters and associated drainage channels of the present invention effectively define an edge of an adjacent athletic surface. In particular, the edge adapters can serve as a dam during formation of the adjacent athletic surface from a moldable material to create a well-defined edge once the moldable material cures. Moreover, the edge adapters of the present invention are preferably resilient so as to elastically deform upon the application of loading forces thereto, thereby improving the feel of the edge adapter underfoot, particularly in comparison with an adjacent running track surface. Further, the edge adapters of the present invention allow at least a portion of the grate to be covered by an athletic playing surface, such as a running track surface and/or an artificial turf surface, to improve the aesthetic appearance of the drainage channel. In addition, the variety of edge adapters of the present invention can permit a single type or style of drainage channel to be installed adjacent a variety of athletic surfaces, thereby increasing the installation flexibility of this drainage system and limiting the fabrication costs associated with manufacturing the drainage channel sections.

The invention has been described in considerable detail with reference to preferred embodiments. However, many changes, variations, and modifications can be made without departing from the spirit and scope of the invention as described in the foregoing specification and defined in the appended claims. For example, while the drainage channels, edge adapters and grates are described in conjunction with athletic playing surfaces, these drainage system components can border and provide drainage for other surfaces without departing from the spirit and scope of the present invention.

That which is claimed is:

1. A drainable athletic playing field comprising:

a drainage channel capable of receiving runoff from the athletic playing field;

an edge adapter cooperably engaged to an upper portion of said drainage channel and having an upstanding portion, said upstanding portion being formed of a resilient and elastically deformable material, and a surface layer formed of a moldable liquid material applied adjacent to said upstanding portion of said edge adapter such that said upstanding portion acts as a dam and restrains the moldable material to thereby define an edge of the athletic playing field once the moldable material cures, said resulting surface layer being elastically deformable such that both said upstanding portion of said edge adapter and the athletic playing surface can at least partially elastically deform in response to loading forces applied thereto.

2. A drainable athletic playing field as defined in claim 1 wherein said edge adapter has an upper edge which defines a level to which the moldable material which forms said surface layer is applied such that said edge adapter serves as an installation guide during formation of said surface layer.

3. A drainable athletic playing field as defined in claim 1 wherein said drainage channel has at least one sidewall having an upper edge, wherein said edge adapter has a base portion which cooperably engages the upper edge of said sidewall, and wherein said athletic playing field further comprises a grate supported by said base portion of said edge adapter over said drainage channel.

4. A drainable athletic playing field as defined in claim 3 wherein said base portion of said edge adapter is formed of a resilient and elastically deformable material such that said grate is cushioned relative to said channel in response to loading forces applied to the grate.

5. A drainable athletic playing field comprising:

a drainage channel having at least one sidewall defining an uppermost surface, the uppermost surface defining an upwardly facing elongate slot therein;

an edge adapter having an upstanding portion and an elongate continuous plug portion for cooperably engaging said slot; and a surface layer formed of a moldable material applied adjacent to said upstanding portion of said edge adapter such that said upstanding portion restrains the moldable material to thereby define an edge of the surface layer once the moldable material cures.

6. A method of forming an athletic playing surface adjacent to a drainage channel comprising the steps of:

forming a subsurface layer adjacent to an upper edge of the drainage channel;

mounting an edge adapter having at least one upstanding portion to the upper edge of the drainage channel;

applying a moldable liquid material over the subsurface layer such that the upstanding portion of the edge adapter acts as a dam and prevents the moldable material from flowing into the drainage channel; and curing the moldable material to thereby form a resilient athletic surface having an edge defined by the upstanding portion of the adapter.

7. A method of forming an athletic playing surface as defined in claim 6 wherein said subsurface layer formation step comprises:

mounting a temporary adapter to the upper edge of the drainage channel, wherein the temporary adapter has a smaller upstanding portion than the upstanding portion of the edge adapter;

forming the subsurface layer to a level corresponding to an upper edge of the upstanding portion of the temporary adapter; and removing the temporary adapter from the upper edge of the drainage channel prior to mounting the edge adapter thereto.

8. A method as defined in claim 7 wherein said subsurface layer formation step further comprises pouring an asphalt layer adjacent the drainage channel and the upstanding portion of the temporary adapter.

9. A method of forming an athletic playing surface over at least a portion of a drainage channel, wherein the drainage channel has a pair of sidewalls which define an open top therebetween for receiving runoff from the athletic playing surface, the method comprising the steps of:

placing a grate over the open top of the drainage channel;

mounting an edge adapter having at least one upstanding portion and at least one drainage opening therein on an upper surface of the grate;

applying a moldable material over the upper surface of the grate such that the upstanding portion of the edge adapter restrains the moldable material; and curing the moldable material to thereby form an athletic surface layer having an edge defined by the upstanding portion of the adapter over which water drains through the drainage opening in the edge adapter and into the drainage channel.

10. A method as defined by claim 9 wherein the grate defines a plurality of linearly disposed, spaced apart openings, and wherein said mounting step comprises securing the edge adapter to the grate such that the drainage opening in the edge adapter is aligned with at least one of the openings defined by the grate.

11. A method as defined by claim 10 wherein the edge adapter defines a plurality of openings, and wherein said mounting step comprises aligning the openings defined by the edge adapter with the openings defined by the grate such that runoff from the athletic playing surface can flow through the edge adapter and the grate and into the drainage channel.

* * * * *